US005797484A

United States Patent [19]

Sentementes

[11] Patent Number: 5,797,484

[45] Date of Patent: Aug. 25, 1998

[54] BOOK OF MATCHES

[76] Inventor: Andrew Sentementes, 147 Woodridge Dr. S., Stamford, Conn. 06902

[21] Appl. No.: 813,010

[22] Filed: Mar. 5, 1997

[51] Int. Cl.[6] ..... A24F 27/00

[52] U.S. Cl. ..... 206/104; 206/119; 206/820

[58] Field of Search ..... 206/104, 116, 206/119, 820

[56] References Cited

U.S. PATENT DOCUMENTS

| | | | |
|---|---|---|---|
| 1,339,975 | 5/1920 | Pfersch | 206/104 |
| 1,658,355 | 2/1928 | Rudd | 206/104 |
| 1,865,716 | 7/1932 | Waldinger | 206/104 |
| 2,042,584 | 6/1936 | Bustmante | 206/104 |
| 2,139,291 | 12/1938 | Topjian | 206/104 |
| 2,303,986 | 12/1942 | Carvos | 206/104 |
| 3,333,688 | 8/1967 | Green, Jr. | 206/820 |
| 3,438,486 | 4/1969 | Pinkas | 206/104 |

*Primary Examiner*—David T. Fidei
*Attorney, Agent, or Firm*—Risto A. Rinne, Jr.

[57] ABSTRACT

A book of matches includes a plurality of matches each of the matches having a match base that includes a flammable match tip at a first end and a remaining end that is disposed opposite to the first end. Each match base at the remaining end is attached to a central strip. An improvement is made to each match base near the remaining end to facilitate removal of the match from the central strip. The improvement consists either of at least one perforation passing through the match base, at least one score line that is cut or impressed into the match base, or a combination of at least one score line and at least one perforation.

16 Claims, 2 Drawing Sheets

BOOK OF MATCHES

BACKGROUND OF THE INVENTION

1. Field of the Invention

The present invention, in general, relates to matches and, more particularly, to book matches or matchbooks as they are also on occasion known.

Book matches are well known. A plurality of matches are attached to paper or cardboard extensions which in turn are stapled to an overlapping heavy paper cover. Each match is torn apart from the book prior to use.

While book matches are ubiquitous they are not perfect. In particular it is often difficult to sever one match apart from the remainder of the book. The paper or cardboard may twist instead of tearing. Sometimes a great deal of force is required to separate a match apart from the remainder of the matches contained in a match-book.

Normally the match is grasped between the thumb and forefinger. As the force required to tear the match apart from the match book increases, so too does the force required to hold on to the match itself. Therefore the person trying to separate one match apart from the remainder must, for hard-to-separate matches, increase the force that he is exerting upon the match with his thumb and forefinger simultaneously with an increase in the pulling force that he is applying, lest he lose his grip upon the match itself.

This problem is exacerbated for certain people, such as the elderly or those with arthritis. Anyone who finds it difficult to forcefully grasp an item will find it difficult to tear apart a match from the book when the match does not easily release.

Accordingly there exists today a need for a matchbook that contains matches that are easy to separate apart from the book.

2. Description of Prior Art

Book matches are, in general, well known. They come in all variety of sizes and shapes and are often used for promotional purposes. They all tend to have in common a plurality of matches that are attached to a central strip. During use each match must be separated apart from the central strip by tearing it off.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a book of matches that makes it easier to separate one match apart from the book.

It is also an object of the invention to provide a book of matches where the maximum force required to separate one match apart from the book can be affected.

Another object of the invention is to provide a book of matches that is easy to manufacture.

Still another object of the invention is to provide a book of matches that is safer to use.

Still yet another object of the invention is to provide a book of matches that produces a match base having a predictable length thereto.

Still yet another important object of the invention is to provide a book of matches that produces a match base having the maximum length that is possible.

Briefly, a book of matches that is constructed in accordance with the principles of the present invention has a plurality of matches attached to at least one central strip. Each individual match includes at least one method to reduce the amount of force that is required to tear the match apart from the central strip. The preferred methods for reducing the amount of force required include perforating the individual matches or scoring at least one side of the matches or a combination thereof.

DETAILED DESCRIPTION OF THE INVENTION

Figure 1:
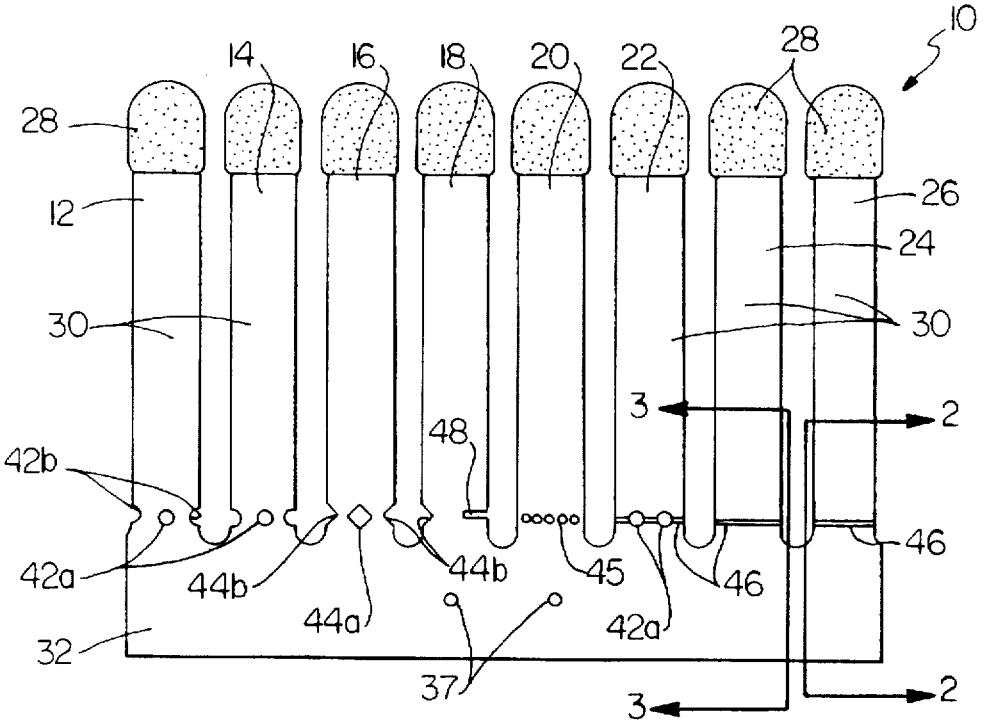
FIG. 1 is a front elevational view of a plurality of matches attached to a central strip showing several methods to make the severing of one match apart from the strip easier to accomplish.

Referring now to FIG. 1 and on occasion to all of the FIGURE drawings, is shown, a plurality of matches identified in general by the reference numeral 10, taken from the inside of a book of matches, the book of matches being identified in general by the reference numeral 38 of FIG. 2 and discussed in greater detail hereinbelow.

Eight matches are shown and are identified respectively by the reference numerals 12, 14, 16, 18, 20, 22, 24, and 26 with reference numeral 12 referring, in particular, to a first match, 14 to a second match, 16 to a third match, 18 to a fourth match, 20 to a fifth match, 22 to a sixth match, 24 to a seventh match, and 26 to an eight match. When it is expedient to refer to a particular match its reference number will be cited along with the particular name assigned to that reference number. When it is expedient to refer to all of the matches simultaneously, all of the reference numbers will be cited along with the name "the matches".

Each one of the matches 12, 14, 16, 18, 20, 22, 24, and 26 contains a flammable match tip 28 that is attached to a first end of a flammable match base 30. The remaining end of each match base 30 is attached to a central strip 32. The strip 32 is usually attached to a matchbook cover 34 (see FIG. 2) by a staple 36 which passes through both the cover 34 and the strip 32 thus forming the book of matches 38.

A plurality of strips (not shown) may be included within the cover 34 by placing each one of the plurality of strips adjacent to and atop each other. This is done when it is desirable to provide a greater number of matches (not shown) for use than the quantity of the matches 12, 14, 16, 18, 20, 22, 24, and 26 that are attached to the strip 32 and contained in the book of matches 38. The FIG. 1 drawing shows the quantity of the matches 12, 14, 16, 18, 20, 22, 24, and 26 that are attached to the strip 32 as eight, although normally ten matches (not shown) are what are attached to the strip 32 and, of course, any number of matches (not shown) can be so attached to a modified strip (not shown).

The strip 32 of FIG. 1 does not include the matchbook cover 34 but it does reveal a pair of holes 37 that are formed by the staple 36 (The staple 36 is not shown in FIG. 1.) when the staple 36 passes through the strip 32 and the cover 34. The cover 34 and the staple 36 have been removed from the view as shown in FIG. 1 to provide better detail of the improvements made.

Figure 2:
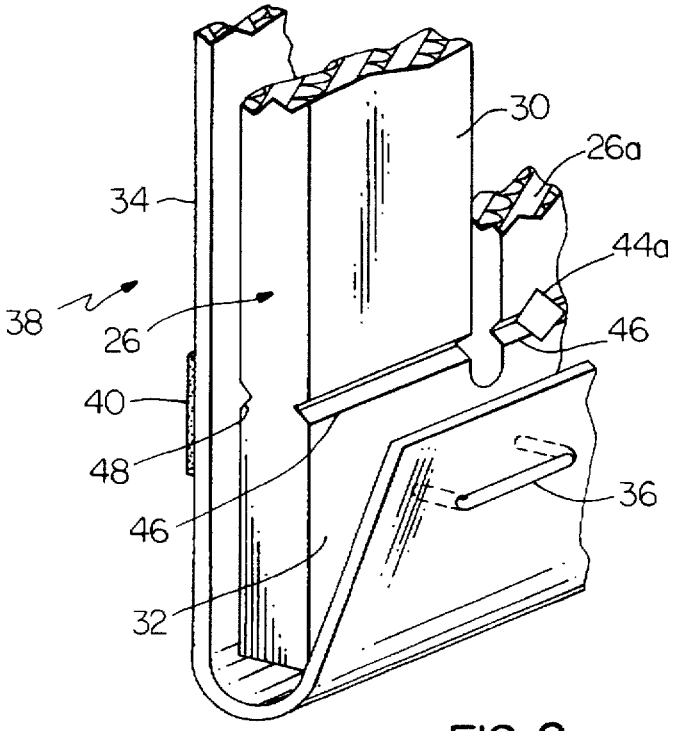
FIG. 2 is a view in perspective as shown in FIG. 1 as seen along the lines 2—2 therein with additional material absent the FIG. 1 drawing that shows a portion of an attached matchbook cover and also an additional match.

Referring to FIG. 2, the staple 36 is used to attach the strip 32 or the plurality of strips to the cover 34 to form the book of matches 38. If desired, a plurality of staples (not shown) may of course be used as well as any other method of securing the strip 32 or the plurality of strips to the cover 34 such as by the use of an adhesive (not shown).

The staple 36 as shown in FIG. 2 appears to be offset from the center of the strip 32. This is accomplished in the FIG. 2 drawing to reveal general details of construction of the book of matches 38 without the need to include in its entirety the strip 32. If the plurality of staples are to be used they may each be attached so as to pass through the cover 34 and the strip 32 where desired. However if the staple 36 is used singularly to attach the strip 32 to the cover 34, it is preferable to do so with the staple 36 disposed near to the geometric center of the strip 32.

The match base 30 and the strip 32 are normally formed of a single piece of either heavy paper stock or of a single piece of light cardboard. Either may be treated, if desired, to control the rate of burn. In either case they would contain cellulose as the primary combustible ingredient. Of course the match base 30 and the strip 32 may be formed of any material as desired and the improvements as herein disclosed would continue to apply. However it is necessary that the match base 30 be of a combustible material to prolong the flammability of each of the matches 12, 14, 16, 18, 20, 22, 24, and 26.

Hereinafter, when the term "cardboard" is used it is intended to refer to either paper, cardboard, or any other material of choice for construction of the match base 30 and the strip 32. The cover 34 is usually also formed of a cardboard material stock similar to that of the base 30 or the strip 32 but lighter in weight and typically with a more attractive finish. However for certain decorative or promotional uses, the cover 34 is comprised of whatever material is desired such as plastic, as the cover need not be combustible.

The strip 32 need not be combustible either, but present manufacturing cost constraints have required that both the strip 32 and the match base 30 for each of the matches 12, 14, 16, 18, 20, 22, 24, and 26 be formed of an original single piece (not shown) of the same material stock that is then partially severed during manufacture to form each match base 30 and, ultimately, each one of the matches 12, 14, 16, 18, 20, 22, 24, and 26. Therefore by this manufacturing method the strip 32 is formed of the same combustible material as the match base 30. Also, the match base 30 for each one of the matches 12, 14, 16, 18, 20, 22, 24, and 26 remains attached to the strip 32 from which it was originally formed. Cardboard is normally used for this purpose.

An abrasive strip 40 is normally attached to the cover 34 and is used to ignite the match tip 28 and then, the match base 30, when the match tip 28 is slid along the abrasive strip 40 so as to produce a rise in temperature from the resultant friction that is sufficient to ignite the match tip 28.

The hereinabove recited description has addressed, in general, the known state of the art. The following description addresses with more particularity the improvements made thereto.

Referring to FIG. 1, each of the matches 12, 14, 16, 18, 20, 22, 24, and 26 include an improvement made to the match base 30 near the remaining end thereof to facilitate removal apart from the strip 32. In particular, the first match 12 and the second match 14 include a plurality of round inner perforations **42*a* respectively at the match base 30** near the remaining end thereof.

The round inner perforations **42*a* are each contained entirely within the confines of the match base 30 as they each pass completely through the match base 30 thereby weakening the base 30 so that less force is required to sever the match base 30 apart from the strip 32**.

The first match 12 and the second match 14 as shown also include a plurality of round outer perforations **42*b* at the edge of the match base 30 near the remaining end thereof. The only difference between the round inner perforations 42*a* and the round outer perforations 42*b* is that the round outer perforations 42*b* are disposed at the side edges of the match base 30 and therefore the circular hole configuration that the round outer perforations 42*b* would normally produce can not be entirely contained within the match base 30 of either the first match 12 or the second match 14. If only one-half of the circle is contained within the match base 30, then only one-half of a circle appears at the edge of the match base 30, as is shown. If the round outer perforation 42*b* is adjacent to another match (as is shown between the first match 12 and the second match 14), then one-half of the circle produced by the round outer perforation 42*b* appears on the edge of the match base 30 of the first match 12 and the remaining half of the circle appears on the adjacent edge of the match base 30 of the second match 14**.

If the inner round perforations **42*a* are to be used then at least one of the inner round perforations 42*a* is used for the match base 30 of the first match 12 and the second match 14. By varying both the size of and the spacing between each of the inner round perforations 42*a* the tear characteristics are adjusted to produce a consistent tearing force while keeping manufacturing costs to a minimum. Similarly when used the size and placement of the outer round perforations 42*b*** are varied to suit.

If desired, the inner round perforations **42*a* may be omitted and only the outer round perforations 42*b* included. If desired, the outer round perforations 42*b* may be omitted and only the inner round perforations 42*a* included. Regardless of which type are used, when a plurality of the inner round perforations 42*a* or outer round perforations 42*b* (or both) are used simultaneously, they are generally disposed along the match base 30 so as to form an imaginary straight line (not shown) that appears to traverse across the match base 30. The match base 30** is weakened where it is perforated and is likely to sever across the imaginary straight line.

As is discussed in greater detail hereinbelow, other shapes may be used to form specially shaped-perforations (not shown) as desired and the preceding discussion appertains equally well to any of the specially shaped-perforations. The shape of the perforation introduces another variable which can affect the ease by which the match base 30 can be severed or torn apart from the strip 32. The four elements that have thus far been disclosed include the size of the perforations, the spacing between the perforations, the location chosen for the perforations on the match base 30, and now the actual shape of the perforations.

The third match 16 is similar to the first match 12 and the second match 14 and accordingly, the above descriptions apply, except for the shape of the perforations used. The third match 16 includes an inner diamond-shaped perforation **44*a* and an outer diamond-shaped perforation 44*b* on opposite edges of the match base 30. The sharp corners of both the inner diamond-shaped perforations 44***a* and the two outer diamond-shaped perforations 44*b* provide a more natural point for tearing to occur and, all other factors being equal, result in a match base 30 that is somewhat easier to tear apart from the strip 32 than that produced by the equivalent use of the inner round perforations 42*a* and the outer round perforations 42*b*.

The selection of the shape of the perforation that is to be used, as with all of the above elements disclosed, is a variable that each manufacturer chooses based upon a consideration of both the ease and the cost of manufacture as well as the ease of removal of the match base 30 apart from the strip 32 and upon a consideration of the intended market. The material that is used for construction of both the match base 30 and the strip 32 also affect the variables associated with choosing the ideal perforation characteristics. Therefore the "right" perforation pattern is apt to vary from manufacturer to manufacturer. For example one manufacturer may decide to produce an especially easy-to-tear product for those people having special needs.

As discussed hereinabove, the perforation weakens the match base and thereby also serves the purpose of providing the imaginary line along which the match base 30 is likely to be severed. This is true to some extent even if only one perforation is used. This then provides an advantage in that by placing the perforation (or perforations) near to the remaining end of the match base in as close a proximity to the strip 32 as is practical, it can be predicted that each of the matches 12, 14, 16, 18, 20, 22, 24, and 26 will sever at this location along the imaginary line thus providing the maximum length possible for the match base 30. When the match base 30 is long, this provides more room for an operator (not shown) to grip the match and it helps to keep the flame (not shown) that forms at the flammable match tip 28 disposed as far away as possible from the fingers (not shown) of the operator. This, accordingly, improves safety.

Prior types of book matches (not shown) are prone to sever their respective types of match bases (not shown) at various locations along the match bases making it difficult to grip a lighted match having an especially short match base (not shown). The present disclosure results in the severed match bases 30 having the maximum length possible. This not only is safer as discussed hereinabove, but it also helps to ensure the maximum possible burn time for each of the matches 12, 14, 16, 18, 20, 22, 24, and 26. This is often useful when the operator is trying to ignite an object that is not readily combustible.

Referring now to the fifth match 20 (The fourth match 18 is discussed hereinbelow) a row of small perforations 45 that are each disposed close together illustrate varying both their size and their placement. It is believed that a greater quantity of the smaller perforations 45 in close proximity with respect to each other help to provide more consistent tear characteristics than result from a lesser quantity of larger perforations such as when only a couple of the inner round perforations 42*a* and the outer round perforations 42*b* are used. Again, this is a manufacturing decision best left to each manufacturer.

Referring now to the eighth match 26 and also to FIG. 2, is shown a front score line 46 and a rear score line 48, each respectively disposed on opposite sides of the match base 30. The rear score line 48 and the front score line 46 are both disposed a similar distance away from from the central strip 32 and are parallel with respect to each other. The front score line 46 and the rear score line 48 are either pressed into the match base 30 or are actually cut into the match base 30. The front score line 46 and the rear score line 48 provide a method of determining where the separation of the match base 30 from the strip 30 will occur, which is along the plane that is defined by the front score line 46 and the rear score line 48. In addition the front score line 46 and the rear score line 48 provide a method of reducing the amount of force that is required to sever the eighth match 26 apart from the strip 32.

To the rear of the eighth match 26 of FIG. 2 is included a modified match 26*a* (The modified match 26*a* is absent from the FIG. 1 drawing.) which includes both the front score line 46 and the rear score line 48 (The rear score line 48 is not visible in this view.) and also an inner diamond-shaped perforation 44*a*. The inner diamond-shaped perforation 44*a* is disposed along the front score line 46 and passes through the match base 30 to the rear score line 48. The use of the front score line 46 and the rear score line 48 in combination with at least one perforation results in the modified match 26*a* that is especially easy to separate apart from the strip 32.

As discussed hereinabove the matchbook cover 34, the staple 36, and the abrasive strip 40 are shown in the FIG. 2 drawing thus providing a partial view of the complete assembly of the book of matches 38 with certain of the improvements visible. Of course, any of the improvements herein disclosed are included, as desired, in the book of matches 38.

Figure 3:
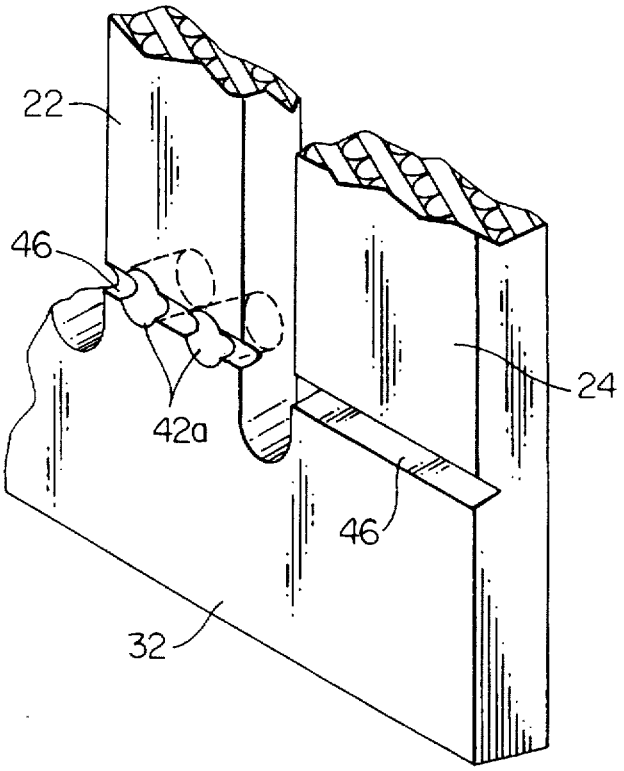
FIG. 3 is a view in perspective as shown in FIG. 1 as seen along the lines 3—3 therein.

Referring now to the sixth match 22 and to the seventh match 24 and also to FIG. 3, a front score line 46 only is included in the match base 30. This too is an effective way to lessen the force required to separate either the sixth match 22 or the seventh match 24 apart from the strip 32 and also to ensure that the separation occurs along the line as defined by the front score line 46.

The sixth match 22 is disposed beside the seventh match 24 and it includes the front score line 46 along with a pair of the round inner perforations 42*a* disposed along the front score line 46 and passing through the match base 30. The front score line 46 and the pair of the round inner perforations 42*a* make separation of the sixth match 22 apart from the strip 32 easier than it would be with only the front score line 46 or with only the pair of the round inner perforations 42*a*.

Referring now back to FIG. 1 and to the fourth match 18, is shown an edge score line 48. The edge score line passes entirely through the match base 30 at an edge of the fourth match 18 and into the match base 30 a predetermined amount. Normally a second edge score line (not shown) would be similarly disposed on the opposite edge of the match base 30. The edge score line 48 similarly weakens the match and encourages the match base 30 to tear at this location. When the edge score line 48 is used in conjunction with the second edge score line, the imaginary line is once again formed increasing the likelihood that the match base 30 will sever at this location.

There is included the outer diamond-shaped perforation 44*b* that is disposed on the opposite edge of the match base 30 away from the edge score line 48. This is to illustrate that the outer diamond-shaped perforations 44*b* can also be made to serve as a modified type an edge score line (not shown) if desired. Again, each manufacturer can best decide from amongst the methods herein disclosed and from possible modifications made thereto which should now be obvious to those having ordinary skill in the art, which method is most appropriate for their particular products.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A book of matches, comprising:

(a) a plurality of matches, each of said plurality of matches including a flammable match tip attached to a first end of a match base, said match base having a remaining end disposed opposite to said first end;

(b) a central strip, each of said plurality of matches attached at a remaining end of said match base to said central strip;

(c) a matchbook cover, said central strip attached to said matchbook cover; and (d) means for facilitating the removal of each of said plurality of matches apart from said central strip, said means included with said match base and wherein said means for facilitating includes at least one score line disposed in said match base and at least one perforation passing through said match base and disposed along said at least one score line wherein said at least one score line includes a second score line, said second score line being disposed on an opposite side of said match base with respect to said at least one score line and parallel with respect thereto.

2. A book of matches, comprising:

(a) a plurality of matches, each of said plurality of matches including a flammable match tip attached to a first end of a match base, said match base having a remaining end disposed opposite to said first end;

(b) a central strip, each of said plurality of matches attached at a remaining end of said match base to said central strip;

(c) a matchbook cover, said central strip attached to said matchbook cover; and (d) means for facilitating the removal of each of said plurality of matches apart from said central strip, said means included with said match base and including at least one perforation passing through said match base and wherein said means for facilitating the removal includes at least one edge score line in said match base.

3. The book of matches of claim 2 wherein said at least one perforation includes a plurality of said perforations.

4. The book of matches of claim 2 wherein said at least one perforation is contained entirely within said match base.

5. The book of matches of claim 2 wherein a portion of said at least one perforation affects an edge of said match base.

6. The book of matches of claim 2 wherein said at least one perforation is of a predetermined configuration.

7. The book of matches of claim 6 wherein said configuation produces a hole having a generally round shape thereto.

8. The book of matches of claim 6 wherein said configuration produces a hole having a generally diamond-shape thereto.

9. The book of matches of claim 2 wherein said at least one perforation includes a plurality of perforations.

10. The book of matches of claim 9 wherein said plurality of perforations are disposed a predetermined distance with respect to each other.

11. The book of matches of claim 2 wherein said means for facilitating the removal includes at least one score line disposed in said match base.

12. The book of matches of claim 11 wherein said least one score line is pressed into said match base.

13. The book of matches of claim 11 wherein said least one score line is cut into said match base.

14. The book of matches of claim 11 wherein said at least one score line includes a second score line, said second score line being disposed on an opposite side of said match base with respect to said at least one score line and parallel with respect thereto.

15. The book of matches of claim 2 wherein at least one staple is used to attach said central strip to said matchbook cover.

16. The book of matches of claim 1 wherein said edge score line includes a predetermined size and shape.

* * * * *